United States Patent [19]

Lonati

[11] Patent Number: 5,018,369

[45] Date of Patent: May 28, 1991

[54] DEVICE FOR ACTIVATING KNITTING CAMS IN CIRCULAR KNITTING MACHINES

[75] Inventor: Francesco Lonati, Brescia, Italy

[73] Assignee: Lonati S.p.A., Brescia, Italy

[21] Appl. No.: 450,501

[22] Filed: Dec. 14, 1989

[30] Foreign Application Priority Data

Dec. 30, 1988 [IT] Italy ..... 23170 A/88

[51] Int. Cl.[5] ..... D04B 15/32

[52] U.S. Cl. ..... 66/40; 66/219; 310/13; 310/14

[58] Field of Search ..... 66/40, 219; 310/13, 310/14, 12 (U.S. only)

[56] References Cited

U.S. PATENT DOCUMENTS

| | | | |
|---|---|---|---|
| 3,218,534 | 11/1965 | Casey | 310/12 X |
| 3,602,745 | 8/1971 | Davis | 310/13 |
| 3,916,646 | 11/1975 | Takigawa et al. | 66/219 |
| 4,234,831 | 11/1980 | Kemmer et al. | 310/12 X |
| 4,496,865 | 1/1985 | Allen et al. | 310/12 X |
| 4,812,934 | 3/1989 | Suzuki et al. | 310/13 X |

FOREIGN PATENT DOCUMENTS

| | | | |
|---|---|---|---|
| 1563200 | 3/1969 | France | 66/219 |

*Primary Examiner*—Werner H. Schroeder
*Assistant Examiner*—John J. Calvert
*Attorney, Agent, or Firm*—Guido Modiano; Albert Josif

[57] ABSTRACT

The device has a box-like supporting structure which slidably accommodates at least one slider arranged laterally facing the needle cylinder of the machine and is movable, by virtue of the action of a linear motor, along a direction which is radial to the needle cylinder. The slider is rigidly associated, with its end which protrudes out of the box-like structure, with a knitting cam which is selectively engageable with needle actuation elements by moving the slider. The slider is constituted by a shaft which is slidably supported, along its axis, by the box-like structure by means of a first bearing which is arranged inside the box-like structure and has balls partially accommodated in longitudinal seats defined on the outer surface of the shaft and in seats correspondingly defined on the inner surface of a bush which extends around the shaft and is prevented from rotating about its axis.

7 Claims, 2 Drawing Sheets

DEVICE FOR ACTIVATING KNITTING CAMS IN CIRCULAR KNITTING MACHINES

BACKGROUND OF THE INVENTION

The present invention relates to a device for activating knitting cams in circular knitting machines.

As known, in knitting machines and in particular in machines for knitting socks and stockings, various kinds of knitting are performed by varying the needles which knit and by varying the path followed by the heels of said needles inside the cam boxes of the needle cylinder. In order to obtain these variations, movable knitting cams can be inserted or extracted, according to the requirements, in the cam boxes of the needle cylinder. Said knitting cams can generally have two insertion positions, and some needles are provided with long heels while others have short heels so that by varying the insertion position of the movable cams it is possible to move to knit only the needles with long heels or all the needles.

The movable knitting cams are generally inserted or extracted from the cam boxes of the needle cylinder with an approaching or spacing-apart motion in a radial direction with respect to the needle cylinder by means of levers which are actuated according to the various knitting requirements.

The U.S. Pat. application No. 07/245.248 in the name of the same Assignee, filed on Sept. 16, 1988, which is incorporated herein by reference, discloses a knitting cam activation device which comprises a frame which slidably supports, along a radial direction with respect to the needle cylinder, a slider arranged facing said needle cylinder with one of its ends to which a knitting cam is fixed. Said slider is fixed, at its other end, to the output shaft of a linear motor driven by an electronic control element which supervises the various operations of the machine and, according to the knitting to be performed, activates the linear motor, which causes a preset movement of the knitting cam in a radial direction with respect to the needle cylinder, so as to cause its insertion in, or extraction from, the cam boxes of the needle cylinder.

Said device allows to insert or extract the movable knitting cams in very short times and can therefore be used with excellent results even on machines with a high-speed needle cylinder rotation without necessarily entailing a reduction in the machine operating speed during the movement of the knitting cams.

The movements imparted to the slider by the linear motor are detected by a linear transducer and are compared to reference values by means of the electronic control element of the machine, thereby ensuring a high degree of precision and repeatability in the actuation of the knitting cams.

In the above described patent application, the slider is supported by the frame by means of a plurality of balls which are partially accommodated in longitudinal grooves defined on the outer surface of the slider and rest on the inner surface of a sleeve which embraces the slider for most of its longitudinal extension.

During testing, said knitting cam activation device has been found to be susceptible to improvements, in particular regarding the sliding coupling between the supporting frame and the slider.

In the device described in the patent application No. 07/245.248, in order to obtain a high-precision actuation of the knitting cams it is in fact necessary to safely exclude any rotation, even a partial one, of the substantially cylindrical slider about its axis. In order to obtain a rotation-preventing coupling of the slider, said slider is inserted with the balls in the sleeve so that the balls are loaded in a transverse direction with respect to the axis of the slider. This fact causes a slight radial deformation of the sleeve in the regions occupied by the balls. This deformation, despite being minimal, can complicate the insertion of the sleeve in the cylindrical seat appropriately provided in the supporting frame. After assembly, the forces which act on the balls and ensure a rotation-preventing coupling to the slider can negatively affect the operation of the linear motor, which must overcome considerable friction resistances when activating the slider.

SUMMARY OF THE INVENTION

The aim of the present invention is to provide a knitting cam activation device in which the friction resistances which act on the slider during its actuation are reduced, while ensuring high precision in the movement of said slider.

Within the scope of the above described aim, an object of the invention is to provide a device which is simple and rapid to assemble.

Another object of the invention is to provide a device in which the linear motor is adequately protected against infiltrations of lubricant, dust or other matter from the outside.

This aim, these objects and others which will become apparent hereinafter are achieved by a device for activating knitting cams in circular knitting machines, which comprises a box-like supporting structure which slidably accommodates at least one slider, arranged laterally facing the needle cylinder of the machine and being movable along a direction which is substantially radial to said needle cylinder, said slider being rigidly associated, with its end which protrudes out of said box-like structure, with a knitting cam which is selectively engageable, by moving said slider, with needle actuation elements, a controllably actuatable linear motor being provided, said motor having its output shaft connected to said slider and having a direction of actuation which is substantially parallel to the direction of motion of said slider, characterized in that said slider is constituted by a shaft which is slidably supported, along its axis, by said box-like structure by means of a first bearing which is arranged inside said box-like structure and has balls partially accommodated in seats defined longitudinally on the outer surface of said shaft and in seats correspondingly defined on the inner surface of a bush which extends around said shaft, means being provided for locking the rotation of said bush about its axis.

BRIEF DESCRIPTION OF THE DRAWINGS

Further characteristics and advantages of the invention will become apparent from the description of a preferred but not exclusive embodiment of the device according to the invention, illustrated only by way of non limitative example in the accompanying drawings, wherein.

DESCRIPTION OF THE PREFERRED EMBODIMENTS

Figures 1, 2:
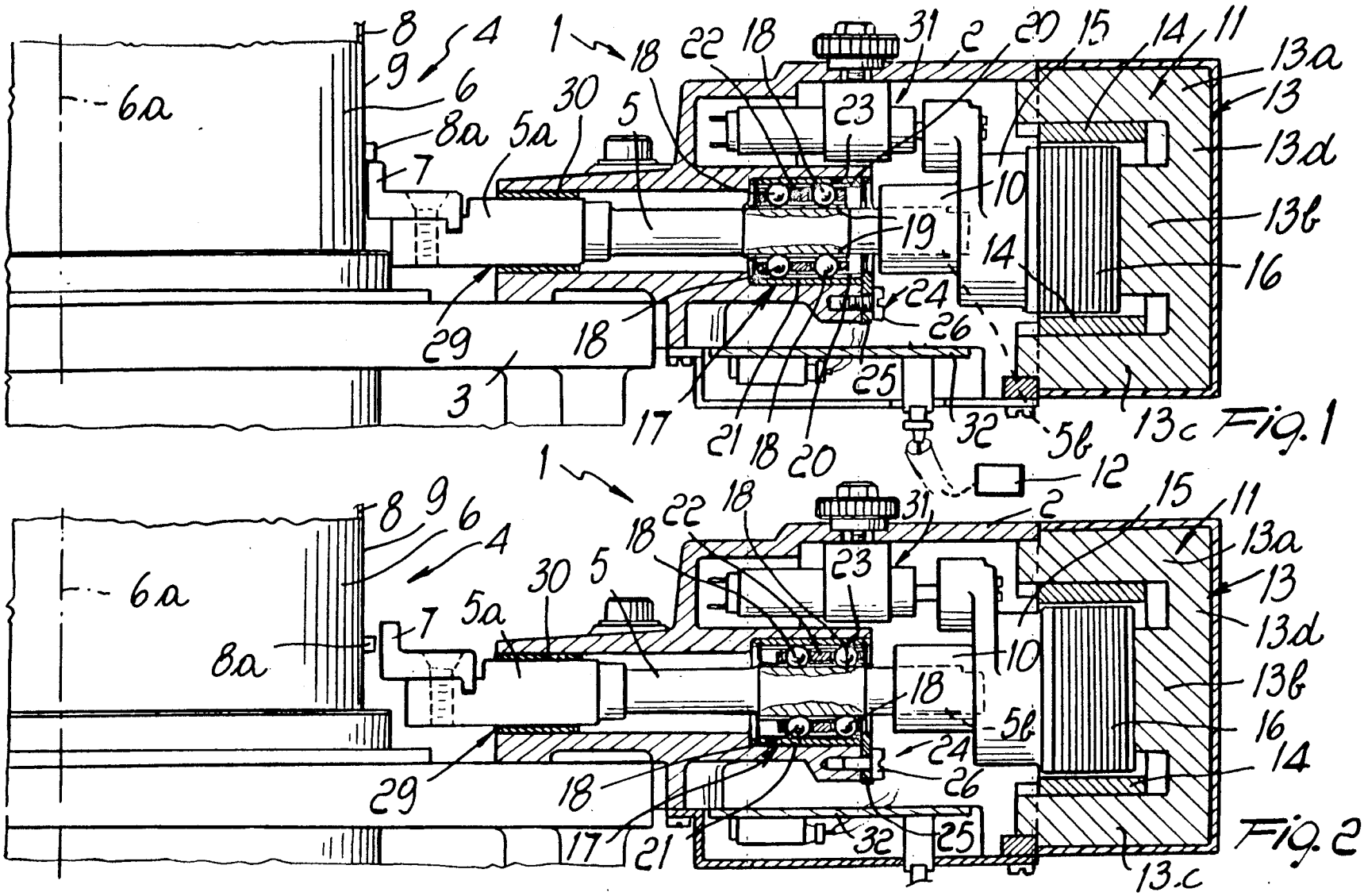
FIG. 1 is a partially sectional lateral elevation view of the device according to the invention arranged facing the needle cylinder of a circular knitting machine with the knitting cam activated.
FIG. 2 is a view of the device according to the invention, similar to FIG. 1, with the knitting cam deactivated.
Figures 3, 4, 5:
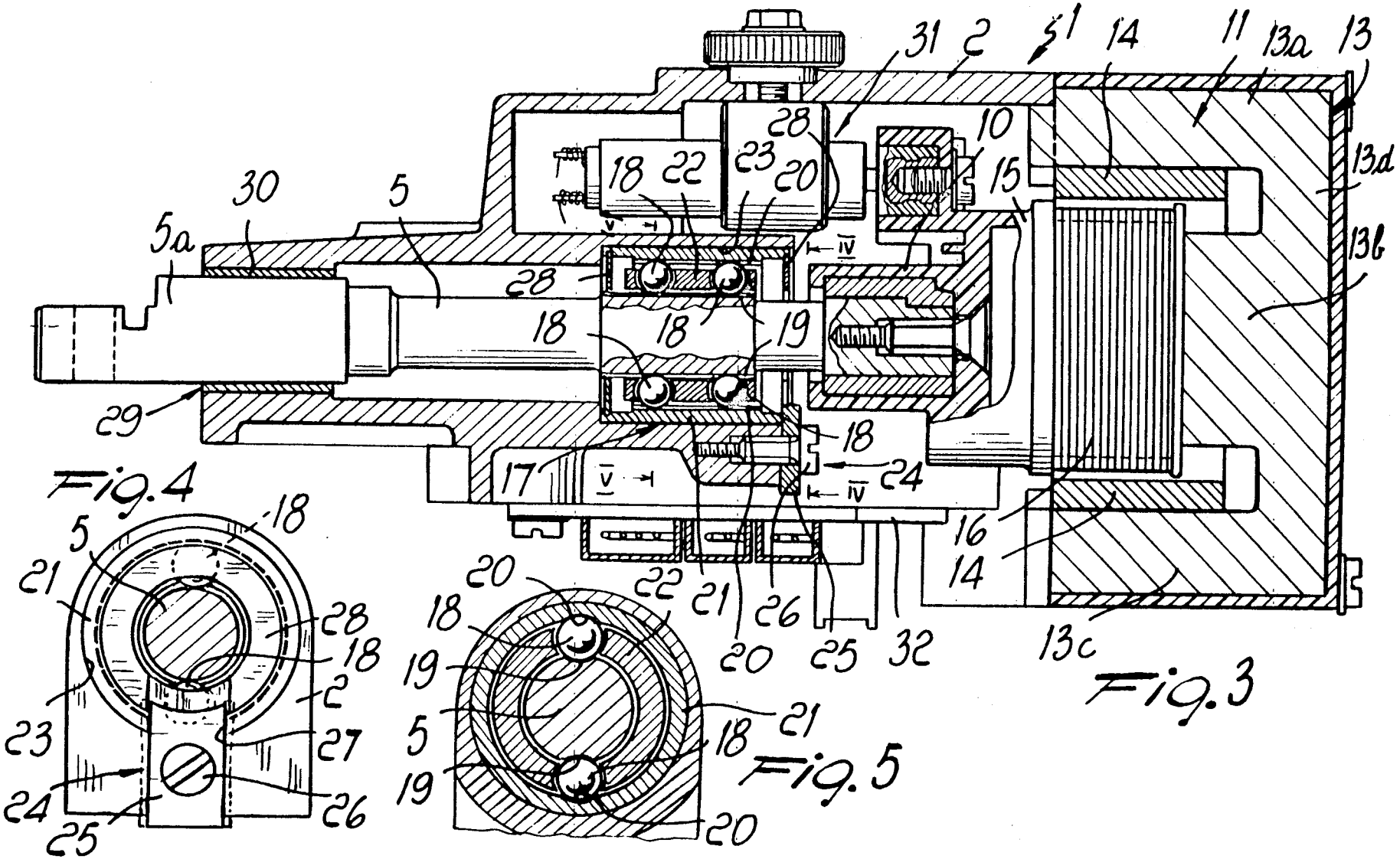
FIG. 3 is an enlarged sectional view of the device according to the invention, taken along a plane which is radial to the needle cylinder.
FIG. 4 is an enlarged sectional view of a detail of FIG. 3, taken along the axis IV—IV.
FIG. 5 is an enlarged sectional view of a detail of FIG. 3, taken along the axis V—V.

With reference to the above described figures, the device according to the invention, generally indicated by the reference numeral 1, comprises a supporting box-like structure 2 which is fixed to the supporting structure 3 of a knitting machine 4 and slidably supports a slider 5 which is movable in a direction which is radial to the needle cylinder 6, i.e. along a direction which is substantially perpendicular to the axis 6*a* of the cylinder 6. The slider 5 has one of its ends 5*a* directed toward the needle cylinder 6 and protruding from the box-like structure 2; a knitting cam 7 is rigidly associated with said end 5*a* and, when the slider 5 moves radially with respect to the needle cylinder, it can engage or disengage needle actuation elements 8. In the illustrated case, said actuation elements are constituted by the heels 8*a* of the needles 8 which protrude radially from the grooves 9 defined in a known manner on the lateral surface of the needle cylinder 6.

The other longitudinal end 5*b* of the slider 5 is fixed to the output shaft 10 of a linear motor 11 which acts on the slider 5 to move it radially with respect to the needle cylinder and is actuated by an electronic control element 12 which supervises the various operations of the machine. The linear motor 11 is arranged inside the box-like structure 2 and is constituted by a body 13 made of ferromagnetic material which has three expansions 13*a*, 13*b* and 13*c* which are substantially parallel to one another and are joined by a crosspiece 13*d*. Blocks 14 made of permanently magnetic material are fixed on the two end expansions 13*a* and 13*c*, and an armature 15 is mounted around the intermediate expansion 13*b* and is movable along said expansion 13*b*. A winding 16 is arranged around the armature 15 and is supplied with direct current so as to generate an electromagnetic force which moves the armature 15 with respect to the body 13 of the linear motor. The armature 15 is rigidly connected to the shaft 10 which constitutes the output shaft of the motor 11.

The linear motor 11 is arranged in the box-like structure 2 so that its direction of actuation is parallel to the sliding direction of the slider 5, and the output shaft 10 is rigidly associated with the slider 5 so that the actuation of the linear motor directly causes the movement of the slider 5 with respect to the box-like structure 2.

According to the invention, the slider 5 is constituted by a shaft with circular transverse cross section which is slidably supported along its axis by a first bearing 17 which is arranged inside the box-like structure 2 and affects a portion of the length of the shaft 5.

The bearing 17 comprises at least one pair of balls 18, two pairs of balls in the illustrated case, which are partially accommodated in seats 19 which extend longitudinally on the outer surface of the shaft 5 in diametrically opposite regions. On the opposite side with respect to the seat 19, the balls 18 are partially accommodated in seats 20 defined longitudinally on the inner surface, in diametrically opposite regions, of a bush 21 arranged coaxially around a portion of the length of the shaft 5.

The balls 18 of the bearing 17 are partially accommodated in an annular cage 22 which extends coaxially around the shaft 5 and can be advantageously made of self-lubricating synthetic material.

The bush 21 is accommodated in a cylindrical seat 23 defined inside the box-like structure 2 and, in order to safely avoid a partial rotation of the shaft 5 about its axis during operation, means 24 are provided for locking the rotation of the bush 21 about its axis.

Said locking means 24 comprise a plate 25 which is arranged radially with respect to the shaft 5 and is fixed, for example by means of a screw 26, to a portion of the box-like structure 2. A portion of the plate 25 enters a radial recess 27 defined on a longitudinal end of the bush 21.

The bearing 17 is closed, proximate to its longitudinal ends, by a pair of covers 28 fixed to the bush 21 and centrally traversed by the shaft 5.

The shaft 5 is advantageously supported, proximate to the opening 29 directed toward the needle cylinder, through which it protrudes out of the box-like structure 2, by a second bearing 30, in this case of the sliding type, which can be conveniently made of self-lubricating synthetic material. In this manner, the bearing 30 also performs the function of preventing infiltrations of oil, dust or other matter inside the box-like structure 2.

The device also comprises means 31 for detecting movement of the slider 5 with respect to the box-like structure 2 which are constituted by a known linear transducer connected to the electronic control element 12 of the machine.

The various electrical connections of the elements arranged inside the box-like structure 2 are provided by means of a printed circuit 32 connected to the winding 16, to the linear transducer 31 and to the electronic control element 12.

In the illustrated embodiment, the box-like structure 2 is mounted on the supporting structure of the machine at a level which corresponds to the lower end of the needles, and the knitting cams act directly on the heel of the needles, but naturally the device according to the invention can be used to activate cams which actuate sliders or sub-needles.

The operation of the device according to the invention is evident from what is described and illustrated, and in particular it is evident that the control element 12 moves the cam 7 to engage or disengage the heel 8*a* of the needles 8 by actuating the linear motor 11, according to the different kinds of knitting the machine must perform.

During operation, oscillation of the shaft 5 about its axis is prevented by virtue of the presence of the balls 18 inserted in the seats 19 and 20. The rotation-preventing locking of the shaft 5 is furthermore obtained with practically no stress on a plurality of balls 18 transversely to the axis of the shaft 5; by virtue of this fact, assembly is extremely easy and friction forces are extremely low.

In practice it has been observed that the device according to the invention fully achieves the intended aim, since it ensures excellent precision in the actuation of the knitting cams with reduced friction resistances.

Furthermore, by virtue of the reduced stresses to which the ball bearing is subjected, a greater life thereof is achieved with reduced maintenance interventions.

The device thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

What is claimed is:

1. Device for activating knitting cams in circular knitting machines and the like, comprising a box like supporting structure which slidably accommodates at least one slider, arranged laterally facing the needle cylinder of the machine and being movable along a direction which is substantially radial to the needle cylinder, said slider being rigidly associated, with its end which protrudes out of said box-like structure, with a knitting cam which is selectively engageable, by moving said slider, with needle actuation elements, a controllably actuatable linear motor being provided, said motor having its output shaft connected to said slider and having a direction of actuation which is substantially parallel to the direction of motion of said slider, wherein said slider is constituted by a shaft which is slidably supported, along its axis, by said box-like structure by means of a first bearing which is arranged inside said box-like structure and has a plurality of balls partially accommodated in seats defined longitudinally on the outer surface of said shaft and in seats correspondingly defined on the inner surface of a bust which extends around said shaft, means being provided for locking the rotation of said bush about its axis.

2. Device according to claim 1, wherein said locking means comprise a plate arranged radially to the axis of said shaft and fixed to a portion of said box-like structure, said plate being inserted in a radial recess defined at a longitudinal end of said bush.

3. Device according to claim 1, wherein said shaft is slidably supported along its axis by said box-like structure by means of a second sliding bearing arranged proximate to an opening of said box-like structure which is directed toward the needle cylinder and is traversed by said shaft.

4. Device according to claim 3, wherein said second sliding bearing is made of self-lubricating synthetic material.

5. Device according to claim 1, wherein said first bearing is closed, proximate to its longitudinal ends, by a pair of covers traversed by said shaft.

6. Device according to claim 1, further comprising:

at least one annular cage interposed between said shaft and said bush, and diametrically opposite regions defined on said shaft, wherein said plurality of balls are arranged at said diametrically opposite regions and are partially contained in said annular cage.

7. Device according to claim 1, further comprising:

at least one annular cage interposed between said shaft and said bush, and diametrically opposite regions defined on said shaft, wherein said plurality of balls are arranged at said diametrically opposite regions and are partially contained in said annular cage, and wherein said plurality of balls comprises two pairs of balls.

* * * * *